United States Patent [19]

Spear

[11] Patent Number: 4,492,487

[45] Date of Patent: Jan. 8, 1985

[54] OVERLAY CODE SELECTION SYSTEM

[76] Inventor: Woodrow Spear, c/o OSOS, 513 W. Mt. Pleasant Ave., Livingston, N.J. 07039

[21] Appl. No.: 364,504

[22] Filed: Apr. 1, 1982

[51] Int. Cl.[3] ..... B42F 13/00; B42D 15/00; B42F 21/10

[52] U.S. Cl. ..... 402/79; 283/70; 40/359

[58] Field of Search ..... 402/80 L, 80 P, 80 R, 402/79; 33/174 B; 434/87, 364; 283/70; 40/359, 360

[56] References Cited

U.S. PATENT DOCUMENTS

| | | | |
|---|---|---|---|
| 1,443,092 | 1/1923 | Pettis | 402/79 |
| 2,879,608 | 3/1959 | Watkins | 434/364 X |
| 3,089,260 | 5/1963 | Gray | 434/364 |
| 3,557,463 | 1/1971 | Perry et al. | 33/174 B |
| 3,846,915 | 11/1974 | Obermark et al. | 33/174 B X |
| 4,185,934 | 1/1980 | Hodson | 402/80 L |

*Primary Examiner*—Paul A. Bell
*Assistant Examiner*—Paul M. Heyrana, Sr.
*Attorney, Agent, or Firm*—Zalkind & Shuster

[57] ABSTRACT

Coded data imprinted in close spaced relation on data sheets retained within a loose leaf binder is selectively marked through cutout openings in a transparent overlay mask. The mask is positioned in proper alignment over each of the data sheets by means of aligning slots through which at least two of the binder rings project.

6 Claims, 4 Drawing Figures

OVERLAY CODE SELECTION SYSTEM

BACKGROUND OF THE INVENTION

This invention relates to a method and means for marking selected coded data on data sheets.

Sometimes costly and often time consuming personnel errors occur in the record keeping systems associated with current product marketing operations. For example, inventory lists of products are recorded in computer memory banks by entry of data to the computer by personnel from a composite listing of such produts. Such products are accordingly identified and listed on data sheets often having two or more code numbers associated with each listed product representing different manufacturing sources. The code numbers are necessarily closely spaced from each other, such as 6 lines per inch. Selections of code numbers on the data sheets are made by color coding applied through use of a marking device such as a pencil or crayon. In view of the closeness between the code numbers, a serious problem arises from inaccurate and/or confusing code selection resulting from erroneous code number marking.

It is therefore an important object of the present invention to minimize code selection errors resulting from mistaken or confusing marking of selected coded data on data sheets.

SUMMARY OF THE INVENTION

In accordance with the present invention, the aforementioned data sheets are adapted to be retained in a conventional type of loose leaf binder having at least two binder rings which extend through punched holes formed in the left hand margin portion of the data sheets. The data sheets when so inserted into the ring binder will be held in proper position for overlay of a transparent mask having cutouts formed therein through which the coded data to be marked is restrictively exposed. Proper positioning of the transparent mask in overlay relation to the data sheets being marked, is achieved by providing elongated slots in the mask which are so dimensioned and located as to receive therethrough the binder rings with a sliding fit. Thus, selected code data associated with inventory lists may be readily marked with a marker implement applied to the desired surface portions of the data sheet exposed through the cutouts. The overlay mask aligning slots enable the mask to be readily applied and removed for marking each of the data sheets which remain in position in the ring binder throughout the selected code marking operations.

BRIEF DESCRIPTION OF DRAWING FIGURES

Other objects and advantages of the invention will become apparent with reference to the accompanying drawings, in which.

DETAILED DESCRIPTION OF THE PREFERRED EMBODIMENT

Figure 1:
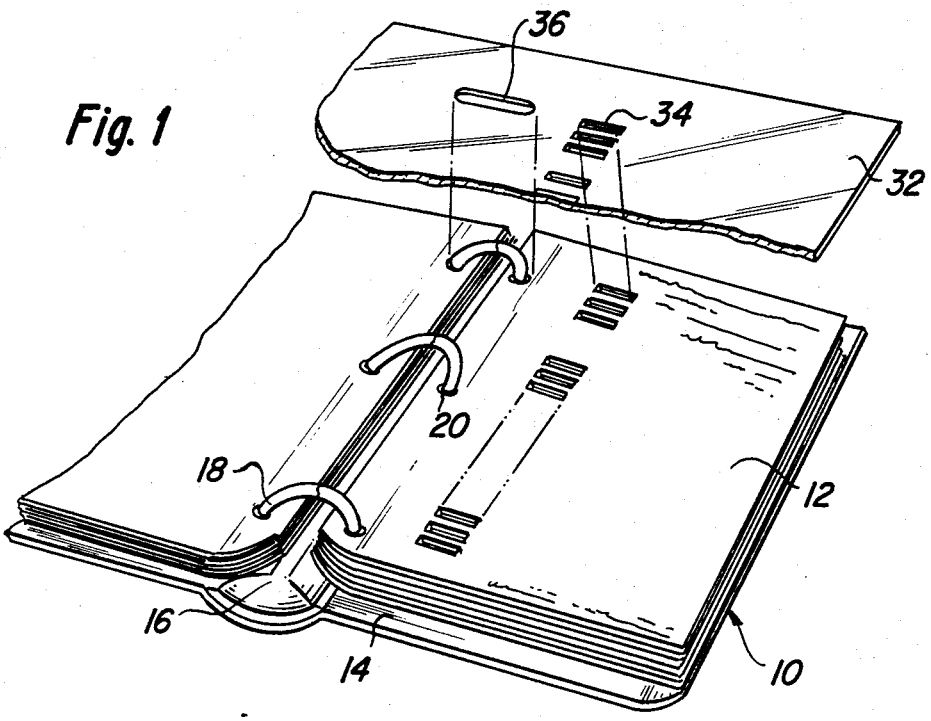
FIG. 1 is a partial perspective view showing a typical installational environment for the present invention.

Referring now to the drawing in detail, a conventional type of loose leaf binder is shown generally referred to by reference numeral 10 within which a plurality of data sheets 12 are retained in the usual manner. Thus, the binder 10 includes a relatively rigid outer cover 14, a mounting bar on spines 16 secured to the cover intermedite opposite edges thereof and a plurality of split sheet retaining rings 18 projecting from the mounting bar through punched out holes 20 formed in the left hand margin portion of the data sheets 12 as more clearly seen in FIG. 1. As is well known, the data sheets are inserted or removed by opening and closing of the binder rings 18.

Figure 2:
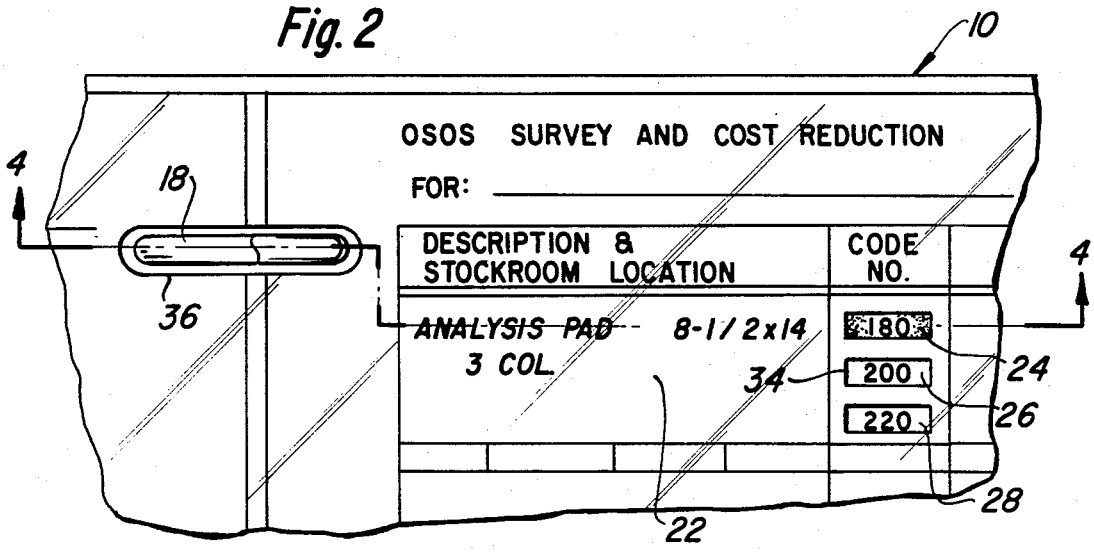
FIG. 2 is an enlarged top plan view showing use of the present invention.
Figure 4:
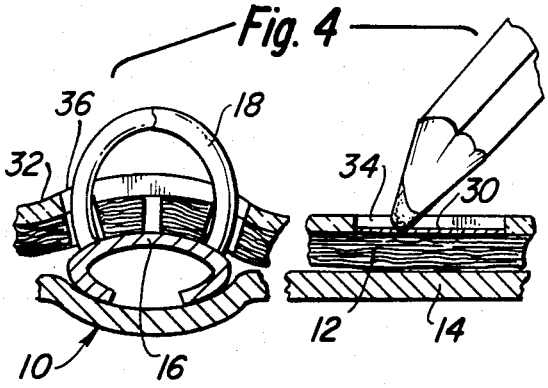
FIG. 4 is a partial side section view taken substantially through a plane indicated by section line 4—4 in FIG. 2.

By way of example only, the data sheets 12 as shown in FIG. 2 contain a printed listing of office supply products, each product being identified in a descriptive title space 22 with a plurality of different code numbers 24, 26 and 28 associated therewith, each code number representing a different manufacturing source. Each group of code numbers are closely spaced in separate lines under a code number column horizontally aligned with the title identification space 22 as shcwn. One of the code numbers 24 as also shown in FIG. 2 has a mark coating 30 covering it so as to indicate a code selection. Such marking of the selected code is effected by means of a marking implement such as a red crayon 32 as shown in FIG. 4. In view of the close spacing between the code numbers 24, 26 and 28, it will be apparent the code selecting operations are susceptible to errors because of mistaken marking of code numbers covering more than one code number and mark coatings extending unintentionally onto portions of the data sheet bordering the coded data.

Figure 3:
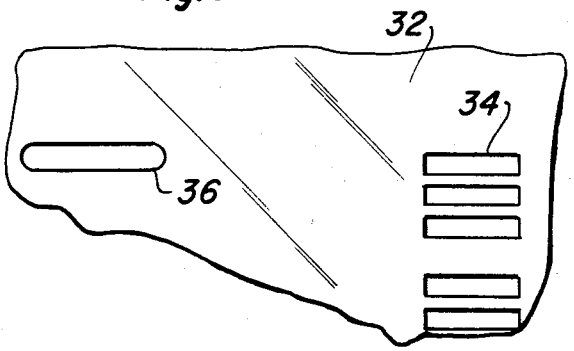
FIG. 3 is a partial top plane view of the trasnparent overlay mask associated with the present invention.

In accordance with the present invention marking of selected code numbers is restrictively confined and facilitated by use of an overlay mask 32 made of any suitable flexible transparent sheet material. The overlay mask is cut to an outer rectangular dimension which will coincide with the three exterior edges of the inserted data sheets 12 and extends across the binder rings 18 when positioned on top of a data sheet 12 as shown in FIGS. 1, 2 and 4. The overlay mask is provided with a plurality of cutout vertically aligned openings 34 as more clearly seen in FIG. 3 dimensioned to restrictively expose the code data 24, 26, 28, etc. These cutout openings are operatively aligned with the code data on an underlying data sheet when the overlay mask is properly positioned in the binder by means of elongated aligning slots 36 formed in the mask, the slots therefore being substantially bisected by a plane aligned with the longitudinal axis of the binder mounting bar 16. The aligning slots are dimensioned and located relative to each other so as to receive therethrough with sliding fits, the binder rings 18 in the closed positions thereof as shown. Thus, placement of the overlay mask with the plural binder rings extending through the aligning slots 36 will properly position the cutout openings 34 so as to restrictively expose only those portions of the underlying data sheet on which the code data is imprinted. The selected code data may therefore be marked with coatings 30 confined by the cutout openings 34 to the selected code data. Further, the cutout openings will provide guidance for manual application of the marking.

It will be apparent from the foregoing description that the overlay mask may be readily applied and removed while the data sheets are retained in the binder and that such data sheets in the binder may be readily marked by hand with less likelihood of error or confusion.

Although the present invention has been described with references to a particular embodiment it will be apparent to those skilled in the art that variations and modifications thereof may be utilized without departing from the principles and spirit of the invention.

What is claimed is:

1. For use with a data sheet bearing certain printed indicia in close spaced relation to each other and a loose leaf binder having a spine and at least two rings projecting therefrom adapted to extend through holes in the sheet when inserted into the binder, a method of marking selected indicia on the sheet by use of a mark applying device, including the steps of: inserting the data sheet into the binder with the rings extending through said holes therein; placing a separate overlay mask having aligning slots and cutouts formed therein over the inserted data sheet to restrictively expose the printed indicia through the cutouts; and marking the selected indicia through the corresponding cutouts in the mask to prevent unintentional marking of portions of the data sheet bordering the selected indicia, said step of placing the mask comprising positioning the mask in the binder bridging the spine with each of the two rings respectively projecting through one of the aligning slots formed in the mask.

2. The method of claim 1 wherein said printed indicia is coded entry data.

3. For use with data sheets bearing closely spaced printed data and a loose leaf binder having a spine with at least two closed rings extending through holes formed in said data sheets to retain the sheets in the binder, means for facilitating the marking of selected data on said data sheets while retained in the binder, comprising a separate overlay mask having data exposing cutouts formed therein, and alignment means for guiding the positioning of the mask in bridging relation to the spine over the underlying one of the sheets, the alignment means including elongated slots formed in the overlay mask dimensioned to receive the closed binder rings therethrough, said slots being located on the mask in operative relation to the cutouts to restrictively expose the printed data when the mask is positioned in the binder.

4. The combination as defined in claim 3 wherein said overlay mask is made of flexible transparent material.

5. In combination with a loose leaf binder having a cover member formed with opposite edges and binder retaining means mounted on said cover member intermediate said opposite edges for receiving a data sheet, and a separate overlay mask having at least one cut-out portion, said mask being positionable over the data sheet, the improvement residing in means for aligning the mask with said data sheet, whereby closely spaced data on the sheet may be selectively marked through the cut-out portion of the mask, comprising aligning slots formed in the mask in operative relation to the cut-out portion, said slots being dimensioned to receive the binder retaining means therethrough and to operatively position the cut-out portion over the data sheet.

6. The combination of claim 5 wherein said binder retaining means includes a spine secured to the cover member and at least two retainer rings extending from the spine through holes formed in the data sheet, the retainer rings in closed condition projecting through the slots with sliding fits.

* * * * *